US006513431B2

(12) United States Patent
Huber

(10) Patent No.: US 6,513,431 B2
(45) Date of Patent: Feb. 4, 2003

(54) PRINTING CYLINDER SLEEVE ASSEMBLY

(75) Inventor: John C. Huber, Hockessin, DE (US)

(73) Assignee: Xymid, LLC, Newark, DE (US)

( * ) Notice: Subject to any disclaimer, the term of this patent is extended or adjusted under 35 U.S.C. 154(b) by 0 days.

(21) Appl. No.: 09/884,846

(22) Filed: Jun. 19, 2001

(65) Prior Publication Data

US 2002/0020317 A1 Feb. 21, 2002

Related U.S. Application Data

(60) Provisional application No. 60/214,122, filed on Jun. 26, 2000.

(51) Int. Cl.[7] ..... B41F 13/10
(52) U.S. Cl. ..... 101/375; 101/376
(58) Field of Search ..... 101/375, 376, 101/401.1, 395; 428/34, 36; 492/18

(56) References Cited

U.S. PATENT DOCUMENTS

| | | | | | |
|---|---|---|---|---|---|
| 3,616,178 | A | * | 10/1971 | Gurin et al. | 101/401.1 |
| 4,903,597 | A | * | 2/1990 | Hoage et al. | 101/375 |
| 5,429,048 | A | * | 7/1995 | Gaffney et al. | 101/216 |
| 5,440,981 | A | * | 8/1995 | Vrotacoe et al. | 101/217 |
| 5,468,568 | A | * | 11/1995 | Kuhn et al. | 101/217 |
| 5,983,799 | A | * | 11/1999 | Lane et al. | 101/375 |

* cited by examiner

*Primary Examiner*—Andrew H. Hirshfeld
*Assistant Examiner*—Jill E. Culler
(74) *Attorney, Agent, or Firm*—Connolly Bove Lodge & Hutz LLP

(57) ABSTRACT

A printing cylinder assembly is in the form of a multi-layer laminate having an inner layer and an outer layer made of readily expandable material. The laminate also includes an intermediate layer which functions as an expansion restricting layer by being made of a material which is less expandable than the inner layer and the outer layer.

20 Claims, 1 Drawing Sheet

PRINTING CYLINDER SLEEVE ASSEMBLY

CROSS-REFERENCE TO RELATED APPLICATION

This application is based on provisional application Ser. No. 60/214,122, filed Jun. 26, 2000.

BACKGROUND OF THE INVENTION

The printing industry uses sleeves as a carrier for mounting printing plates on the print cylinder so that the printing plate is not mounted directly on the cylinder. This results in the advantage that one can leave the printing plates mounted to the less expensive sleeve rather than requiring unmounting the plates from the base print cylinder or having to tie up an expensive print cylinder while an idle job remains mounted. Frequently the same printing plate will be used in the near future and thus using the sleeve will save on set up time.

Various approaches have been taken in the art to provide carrier sleeves for such printing cylinders. Reference is made to U.S. Pat. Nos. 3,978,254, 4,030,415, 4,601,928, 4,903,597, 5,215,013, 5,256,459, 5,301,610, 5,425,693 and 5,458,708 which exemplify known approaches. All of the details of these patents are incorporated herein by reference thereto.

A general approach taken in the prior art is to use an expandable sleeve which would be initially of an inside diameter no greater than and preferably smaller than the outside diameter of the cylinder. The cylinder includes structure for causing the sleeve to expand so that the sleeve can then be assembled onto the cylinder in a sliding movement. A concern with this approach is that if the sleeve too readily expands, plate buckling might occur.

SUMMARY OF THE INVENTION

An object of this invention is to provide an improved printing cylinder sleeve assembly which overcomes disadvantages of the prior art approaches.

A further object of this assembly is to provide such a printing cylinder sleeve assembly wherein structure is incorporated to restrict the degree of expansion.

A still further object of this invention is to provide such a printing cylinder assembly which would be economical to make without sacrifice to the ease of mounting the sleeve on the cylinder.

In accordance with this invention the sleeve is in the form of a multi-layer laminate wherein the inner and outer layers are of a readily expandable material, such as the types of materials used in the prior art. The laminate includes at least one intermediate layer which is less expandable in its characteristics, having greater stiffness, so as to restrict the total expansion of the laminate sleeve assembly.

In a preferred practice of this invention the intermediate layer is made of conventional paper such as kraft paper or newsprint, impregnated paper, pulp/paper products, scrim, very thin fiberglass fabric, aluminum sheets and/or other suitable non-woven material. The expansion restricting layer is preferably continuous by being a non-perforated sheet. Alternatively the sheet could have holes or openings. The layer may also be discontinuous by being in the form of individual spaced strands or strips located between the inner and outer layers. Where plural expansion restricting layers are used, the individual layers may be of the same or of different structure than each other.

THE DRAWINGS

DETAILED DESCRIPTION

Figure 1:
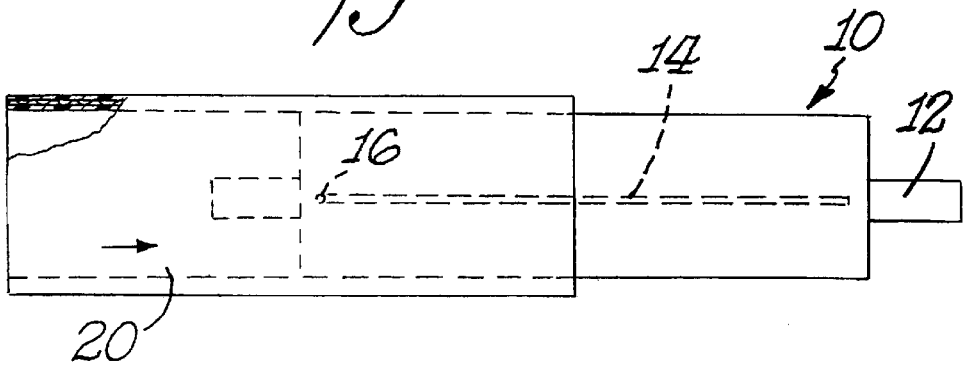
FIG. 1 is a side elevational view partly broken away of a printing cylinder sleeve assembly in the process of being mounted on a printing cylinder.

FIG. 1 illustrates a conventional printing cylinder 10 which includes stub or shaft ends 12 and which includes an air duct 14. Air duct 14 has an air inlet in an end wall and an outlet 16 at its periphery, comprised of one outlet with a peripheral groove or numerous outlets equally spaced around the periphery.

FIG. 1 also illustrates a sleeve assembly 20 in accordance with this invention. As shown therein, sleeve assembly 20 would be mounted on cylinder 10 by positioning one end of the sleeve assembly 20 at the end of the cylinder having outlet 16. Sleeve assembly 20 would be stretched over the end of cylinder 10 and over outlet 16. Compressed air would be fed through the inlet of duct 14 and would exit through duct 14 at outlet 16. The force of the compressed air would cause sleeve assembly 20 to expand thus permitting the expanded sleeve assembly to be moved forward around cylinder 10 in the direction shown by the arrow. The mounting of sleeve assembly 20 results from the compressed air causing the sleeve assembly to expand so that although the inner diameter of sleeve assembly 20 is initially no greater than and preferably less than the outer diameter of cylinder 10, the expanded sleeve assembly is stretched to a sufficient amount to permit the slidable mounting of sleeve assembly 20 until it is in its fully mounted position in the manner known in the art. When it is desired to remove sleeve assembly 20, compressed air is again fed through duct 14 and out of outlet 16 to cause the sleeve assembly to again expand at its end where outlet 16 is located permitting the reverse movement to take place so that the sleeve assembly may be dismounted in the direction opposite to that of the arrow shown in FIG. 1. Between these movements a printing plate is mounted to the outer surface of sleeve assembly 20.

Figure 2:
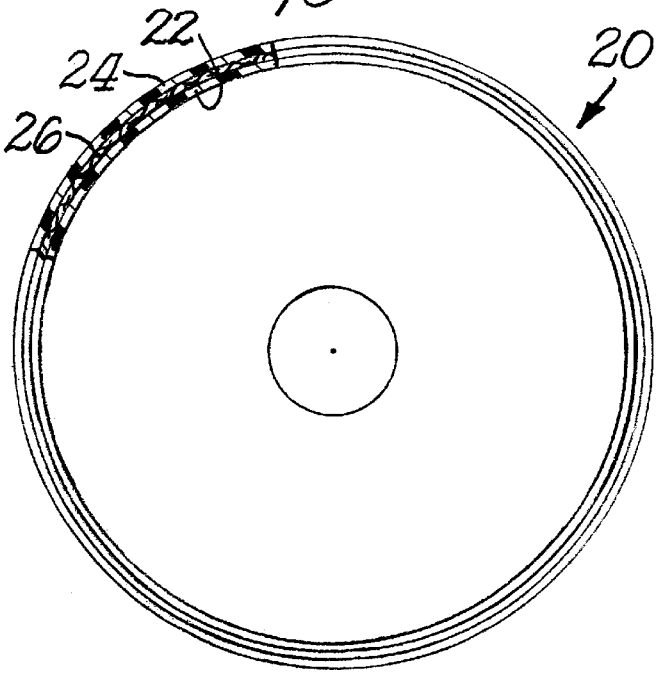
FIG. 2 is an end elevational view partly broken away of the sleeve assembly and cylinder shown in FIG. 1.
Figure 3:
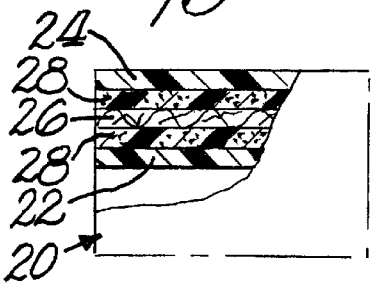
FIG. 3 is an enlarged fragmental side elevational view of the sleeve assembly shown in FIGS. 1–2.

In accordance with this invention sleeve assembly 20 is formed of a multi-layer laminate. FIG. 2 illustrates the laminate to include an inner layer of conventional material such as the types of materials disclosed in the above noted patents including, but not limited to, PET. This inner layer has sufficient smoothness and hardness to mount directly on the outer surface of cylinder 10. An outer layer 24 is provided which preferably has similar expansion characteristics as inner layer 22. Outer layer 24 may be made of the same material as inner layer 22 and has the desired characteristics so that a printing plate would be mounted on the sleeve outer layer. Sleeve assembly 20, in accordance with this invention, includes at least one intermediate layer 26 made of a material which is less expandable under pressure than layers 22,24. As a result, when sleeve assembly 20 is subjected to the force of compressed air, expansion is permitted but the degree of expansion is restricted by the inclusion of intermediate layer 26. Layer 26 is secured to inner and outer layers 22 and 24 by layers of adhesive. FIG. 3, for example, illustrates inner and outer layers 22,24 made of a highly expandable material and secured to central intermediate layer 26 by adhesive layers 28,28.

Any suitable material may be used for intermediate layer 26. What is important is that the intermediate layer has greater stiffness and is thus less expandable than the inner and outer layers. As previously noted, suitable materials include various types of paper, such as kraft paper and brown wrapping paper. In addition, newspaper could be recycled for use as layer 26. Other suitable materials include very thin fiberglass fabric, aluminum sheets and non-woven materials. The gauge of the plastic (polymeric) layers 22, 24 and the gauge of the intermediate layer 26 will also alter the expansion characteristics.

In the preferred practice of the invention the inner layer 22 and outer layer 24 are made of the same material to provide the sleeve assembly with the necessary characteristics for mounting the sleeve assembly on a printing cylinder and for having a printing plate mounted to the outer surface of the sleeve assembly. The expansion restricting layer 26 is thus a non-exposed layer where use is made of its characteristic of being less expandable so as to thereby restrict or limit the degree of expansion which in turn would address any concerns for the plate buckling as might occur where there is too much expansion.

Conventionally, a polymeric sleeve, when subjected to an internal pressure, would expand at least twice as much as a polymeric sleeve with an intermediate expansion restricting layer. This reduced expansion, however, is still sufficient to permit the mounting and removal of the sleeve assembly to and from the printing cylinder. Generally, the overall thickness of the cylinder sleeve assembly would be in the range of 0.01 to 0.120 inches.

Figure 4:
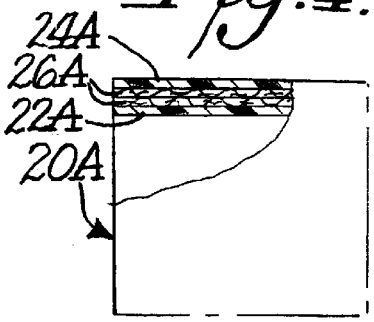
FIG. 4 is a fragmental side elevational view of an alternative sleeve assembly in accordance with this invention.

It is to be understood that the invention may be practiced where the laminate which forms the sleeve assembly has more than three layers (not counting the adhesive layers). Thus, for example, FIG. 4 illustrates a sleeve assembly 20A to include inner and outer layers 22A and 24A. Sleeve assembly 20A, however, also includes two intermediate layers 26A. The provision of two layers may be preferable to result in different characteristics of the laminate. For example, the overall thickness of the sleeve assembly could be increased where desired by the provision of multiple intermediate layers. One of the intermediate layers could be selected for reasons other than restricting expansion. For example, one intermediate layer could be foam to give the sleeve assembly a cushioning characteristic and/or increase its thickness.

The expansion restricting layer is preferably continuous by being a non-perforated sheet. Alternatively the sheet could have holes or openings. The layer may also be discontinuous by being in the form of individual spaced strands or strips located between the inner and outer layers. Where plural expansion restricting layers are used, the individual layers may be of the same or of different structure than each other.

As noted FIG. 3 illustrates a single expansion restricting layer and FIG. 4 illustrates two layers, one or both of which could be expansion restricting layers. The invention may, of course, also be practiced with more than two intermediate layers one or more of which could be expansion restricting layers and/or layers having other functions.

What is claimed is:

1. A printing cylinder sleeve assembly comprising a multi-layer laminate in tubular form, said laminate including an inner layer and an outer layer, said inner layer and said outer layer being made of a material capable of expanding under the force of compressed air and then tending to return toward their unexpanded condition when the compressed air force is removed, and at least one intermediate layer between said inner layer and said outer layer, said intermediate layer being made of a material capable of expanding but being less expandable than said inner layer and said outer layer, said intermediate layer being secured to said inner layer and to said outer layer, and said intermediate layer comprising controlled expansion restricting structure which permits both said inner layer and said outer layer to expand and controls their expansion in accordance with the expansion of said intermediate layer.

2. The assembly of claim 1 wherein said intermediate layer is secured to said inner layer and to said outer layer by layers of adhesive.

3. The assembly of claim 2 wherein there are a plurality of adjacent intermediate layers.

4. The assembly of claim 3 wherein said plurality of intermediate layers have different characteristics from each other.

5. The assembly of claim 4 wherein one of said intermediate layers is a cushioning layer.

6. The assembly of claim 1 wherein there are a plurality of adjacent intermediate layers.

7. The assembly of claim 1 wherein each of said inner layer and said outer layer is made of PET, said intermediate layer being made of paper, and said intermediate layer being in the form of a continuous sheet.

8. The assembly of claim 1 wherein said intermediate layer has greater stiffness than the stiffness of each of said inner layer and said outer layer.

9. The assembly of claim 1 wherein said assembly has a thickness in the range of 0.01 to 0.120 inches.

10. The assembly of claim 1 in combination with a printing cylinder, and said inner layer being mounted against the outer surface of said printing cylinder.

11. The combination of claim 10 wherein said printing cylinder includes an air duct having at least one outlet exposed at the outer periphery of said printing cylinder whereby compressed air may be fed through said duct and discharged through said outlet against said sleeve assembly.

12. The combination of claim 10 including a printing plate mounted against said outer layer.

13. The assembly of claim 1 wherein said intermediate layer is in the form of a plurality of spaced strands or strips.

14. The assembly of claim 1 wherein said intermediate layer controls the expansion of said sleeve assembly to at least one-half of the expansion said sleeve would have without said intermediate layer as part of said laminate.

15. A printing cylinder sleeve assembly comprising a multi-layer laminate in tubular form, said laminate including an inner layer and an outer layer, said inner layer and said outer layer being made of a material capable of expanding under the force of compressed air and then tending to return toward their unexpanded condition when the compressed air force is removed, an intermediate layer between said inner layer and said outer layer, said intermediate layer being made of a material capable of expanding but being less expandable than said inner layer and said outer layer, said intermediate layer being secured to said inner layer and to said outer layer, said intermediate layer being less expandable than any other layers in said multilayer laminate, all of said layers in said laminate being expandable under the force of compressed air against said inner layer, and the extent of expansion of all of said layers being controlled by the extent of expansion of said intermediate layer.

16. The assembly of claim 15 wherein said intermediate layer is secured directly to said inner layer and directly to said outer layer by layers of adhesive.

17. The assembly of claim 15 wherein there are a plurality of adjacent intermediate layers.

18. The assembly of claim 17 wherein said plurality of intermediate layers have different characteristics from each other.

19. The assembly of claim 15 wherein each of said inner layer and said outer layer is made of PET, said intermediate layer being made of paper, and said intermediate layer being in the form of a continuous sheet.

20. The assembly of claim 15 wherein said intermediate layer controls the expansion of said sleeve assembly to at least one-half of the expansion said sleeve would have without said intermediate layer as part of said laminate.

* * * * *